US009403542B2

(12) United States Patent
Nooren

(10) Patent No.: US 9,403,542 B2
(45) Date of Patent: Aug. 2, 2016

(54) RAIL CAR

(71) Applicant: Mammoet USA South Inc., Rosharon, TX (US)

(72) Inventor: Piet Nooren, Lake Jackson, TX (US)

(73) Assignee: Mammoet USA South, Inc., Rosharon, TX (US)

( * ) Notice: Subject to any disclaimer, the term of this patent is extended or adjusted under 35 U.S.C. 154(b) by 115 days.

(21) Appl. No.: 13/962,465

(22) Filed: Aug. 8, 2013

(65) Prior Publication Data

US 2015/0040794 A1 Feb. 12, 2015

(51) Int. Cl.
*B61F 5/38* (2006.01)
*B61F 3/08* (2006.01)
*B61F 5/14* (2006.01)

(52) U.S. Cl.
CPC ... *B61F 5/38* (2013.01); *B61F 3/08* (2013.01); *B61F 5/14* (2013.01)

(58) Field of Classification Search
CPC ..... B61F 5/38; B61F 5/14; B61F 3/00
See application file for complete search history.

(56) References Cited

U.S. PATENT DOCUMENTS 564,585 A 7/1896 Behrends
1,503,999 A 8/1924 Sheal
1,601,017 A 9/1926 Frye
1,851,486 A 3/1932 Backhall
3,417,711 A * 12/1968 Lich ..... 105/165
3,455,252 A * 7/1969 Lich ..... 105/199.2
3,788,237 A * 1/1974 Dieckman et al. ..... 410/45
3,827,366 A 8/1974 Pamer
3,841,275 A 10/1974 Servici
3,855,937 A 12/1974 Caudill
4,150,628 A 4/1979 Keldenich
4,160,420 A * 7/1979 Hackbarth et al. ..... 410/45
4,164,188 A * 8/1979 Hallam et al. ..... 105/166
4,164,906 A * 8/1979 Nieviarovski ..... 105/392.5
4,346,790 A * 8/1982 Morrison et al. ..... 188/47
4,357,878 A 11/1982 Fedele
4,596,194 A 6/1986 Paton
4,648,326 A * 3/1987 Jackson ..... 105/168
4,981,083 A * 1/1991 Cripe ..... 105/4.3
5,802,981 A 9/1998 Kassab
6,017,175 A 1/2000 Kassab
6,240,853 B1 6/2001 Kassab
6,279,693 B1 8/2001 Wiebe
6,286,435 B1 9/2001 Kassab
6,345,661 B2 2/2002 Kassab
6,397,985 B2 6/2002 Wiebe (Continued)

FOREIGN PATENT DOCUMENTS

WO WO2010066621 A1 6/2010

*Primary Examiner* — Jason C Smith

(57) ABSTRACT

The following disclosure relates to a rail car. In one embodiment, a railcar can comprise a span bolster, outer truck assemblies, and a middle truck assembly. The outer truck assemblies can be rotatably mounted to each end of the span bolster. The middle truck assembly can be slidably mounted at a middle portion of said span bolster. In another embodiment, a railcar system can comprise a pair of railcars and a body. The rail cars can comprise a span bolster, outer truck assemblies, and a middle truck assembly. The outer truck assemblies can be rotatably mounted to each end of the span bolster. The middle truck assembly can be slidably mounted at a middle portion of said span bolster. The body can have two ends, each of the ends connected to one of the span bolsters.

14 Claims, 11 Drawing Sheets

(56) References Cited

U.S. PATENT DOCUMENTS

| | | | | |
|---|---|---|---|---|
| 6,827,024 | B2 | 12/2004 | Kassab | |
| 6,871,598 | B2 * | 3/2005 | Schaller et al. | 105/168 |
| 8,192,117 | B1 * | 6/2012 | Landrum et al. | 410/45 |
| 8,196,519 | B2 | 6/2012 | Kumar | |
| 2003/0217669 | A1 | 11/2003 | Kassab | |
| 2005/0183625 | A1 * | 8/2005 | Goding et al. | 105/182.1 |
| 2008/0000381 | A1 | 1/2008 | Bartley | |
| 2011/0079168 | A1 | 4/2011 | Kumar | |
| 2011/0139031 | A1 * | 6/2011 | Larson et al. | 105/215.2 |
| 2012/0103228 | A1 * | 5/2012 | Elizondo | 105/141 |
| 2012/0253565 | A1 | 10/2012 | Kumar | |
| 2013/0220167 | A1 * | 8/2013 | Goding | 105/82 |
| 2014/0158015 | A1 * | 6/2014 | Shimokawa et al. | 105/165 |
| 2014/0261062 | A1 * | 9/2014 | Ozaki et al. | 105/168 |
| 2015/0040794 | A1 * | 2/2015 | Nooren | 105/201 |
| 2015/0114252 | A1 * | 4/2015 | Sato et al. | 105/199.1 |
| 2015/0183443 | A1 * | 7/2015 | Iwamura et al. | 188/267 |

* cited by examiner

RAIL CAR

BACKGROUND

This disclosure relates to an improved rail car.

Railcars have evolved from simple four-wheel, fixed axle vehicles to multi-axle vehicles having sophisticated trucks for significantly improved maneuverability. Such improvements have allowed railcars to move larger loads at greater speeds. One system used to move large loads is a Schnabel car. A Schnabel car uses a combination of trucks, load spreaders and span bolsters to distribute a load over an expanded portion of track.

One prior Schnabel car utilized a rail car freight car having twelve axles. The arrangement specifically utilized two span bolsters each with three 2-axle trucks rotatably mounted on each span bolster. Such arrangement improved dynamic performance on curved track sections, however, having three rotatable points on each span bolster can provide some unpredictability in load movement on track curves.

As such it would be useful to have an improved rail car.

SUMMARY

The following disclosure relates to a rail car. In one embodiment, a railcar can comprise a span bolster, outer truck assemblies, and a middle truck assembly. The outer truck assemblies can be rotatably mounted to each end of the span bolster. The middle truck assembly can be slidably mounted at a middle portion of said span bolster.

In another embodiment, a railcar system can comprise a pair of railcars and a body. The rail cars can comprise a span bolster, outer truck assemblies, and a middle truck assembly. The outer truck assemblies can be rotatably mounted to each end of the span bolster. The middle truck assembly can be slidably mounted at a middle portion of said span bolster. The body can have two ends, each of the ends connected to one of the span bolsters.

DETAILED DESCRIPTION

Described herein is a system and method for an improved rail car. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
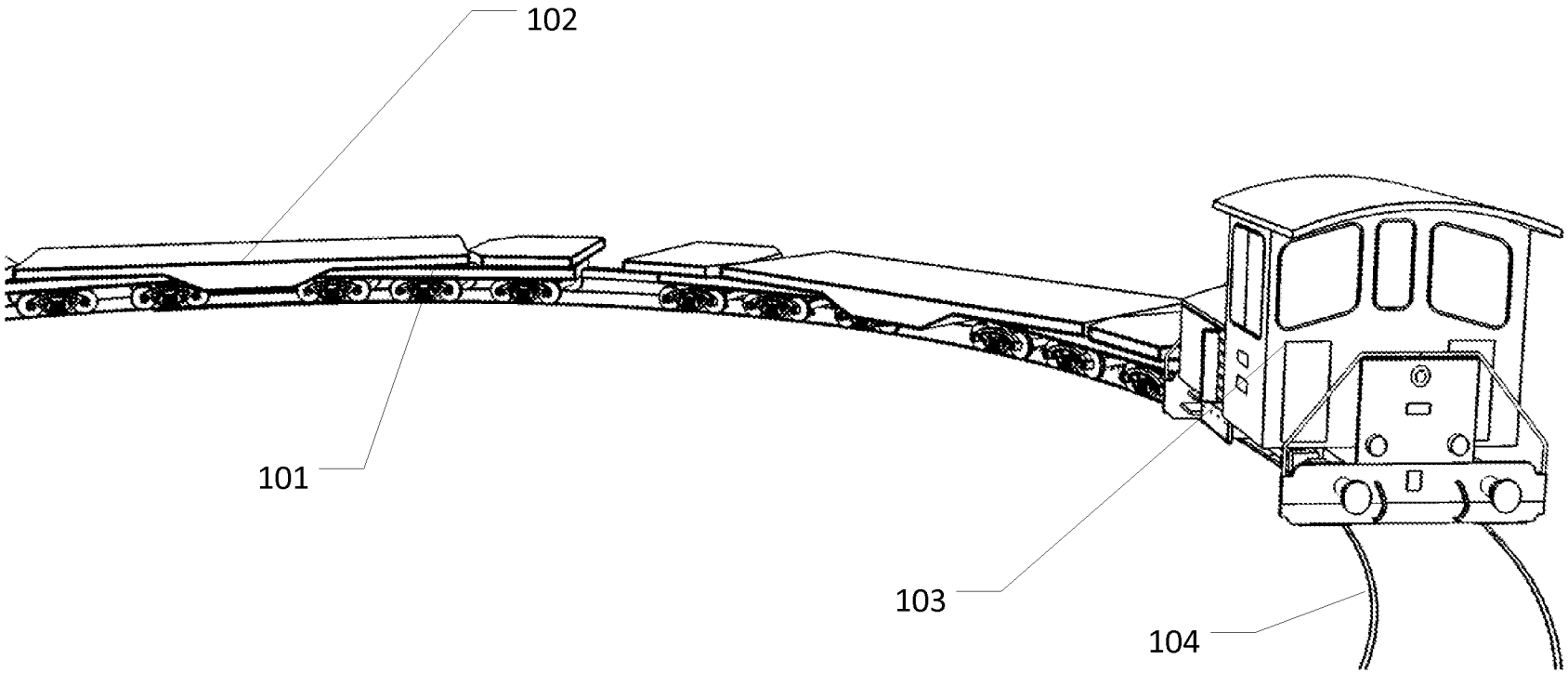
FIG. 1 illustrates railcar system on a railway.

FIG. 1 illustrates a train 100. Train 100 can comprise a plurality of railcars 101 and railcar system 102. Railcar 101 can be any wheeled vehicle configured to move on railway 104. Railcar system 102 can be a plurality of railcars 101 and other components coupled together. Train 100 can further comprise a powered vehicle 103. Powered vehicle 103 can direct the movements of railcar system 102 and railcar as it moves on a railway 104. Railcar system 102 can be powered or unpowered rail vehicle that can be coupled together and configured to operate on railway 104. Railcar system 102 can be used to carry oversized loads. Railway 104 can provide a runway for train 100. Railway 104 can comprise curves.

Figure 2:
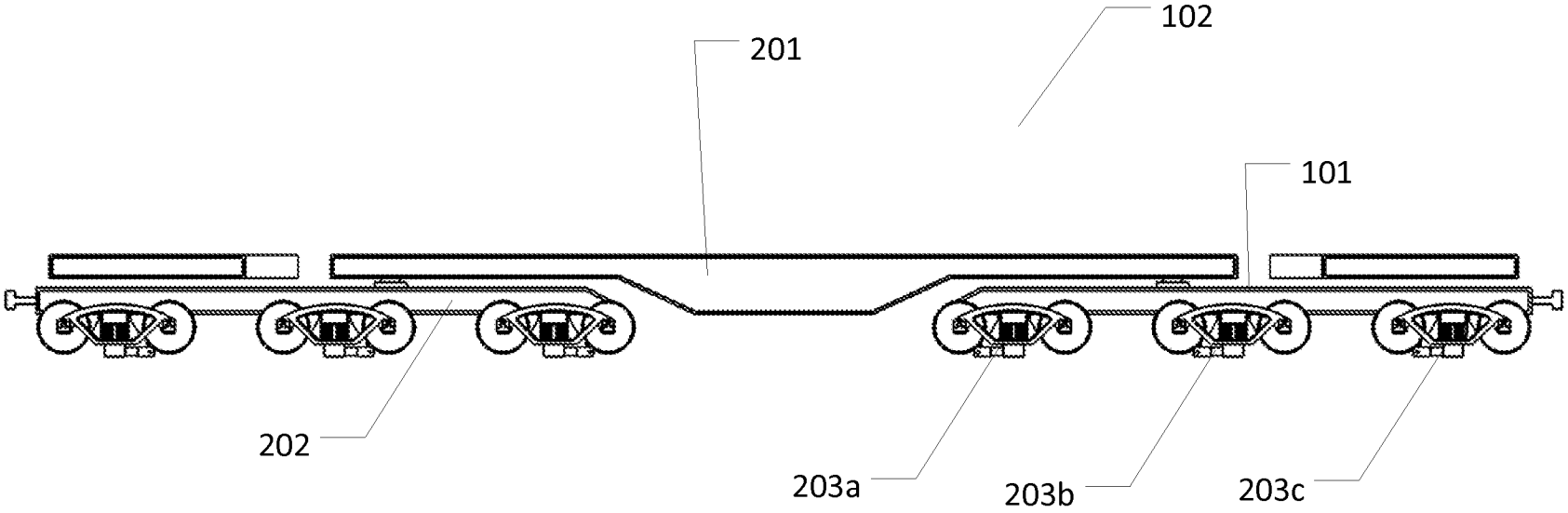
FIG. 2 illustrates a railcar comprising a truck body, a pair of span bolsters, and a plurality of truck assemblies.

FIG. 2 illustrates a railcar system 102 comprising a plurality of railcars 101 and a truck body 201. Railcar 101 can comprise a span bolster 202, and a plurality of truck assemblies 203. Truck body 201 can connect be a support structure that connects to multiple span bolsters 202. In one embodiment, truck body 201 can be rotatably connected to span bolsters 202. Span bolsters 202*a* and 202*b* can be mounted at the opposite ends of truck body 201.

Figure 3:
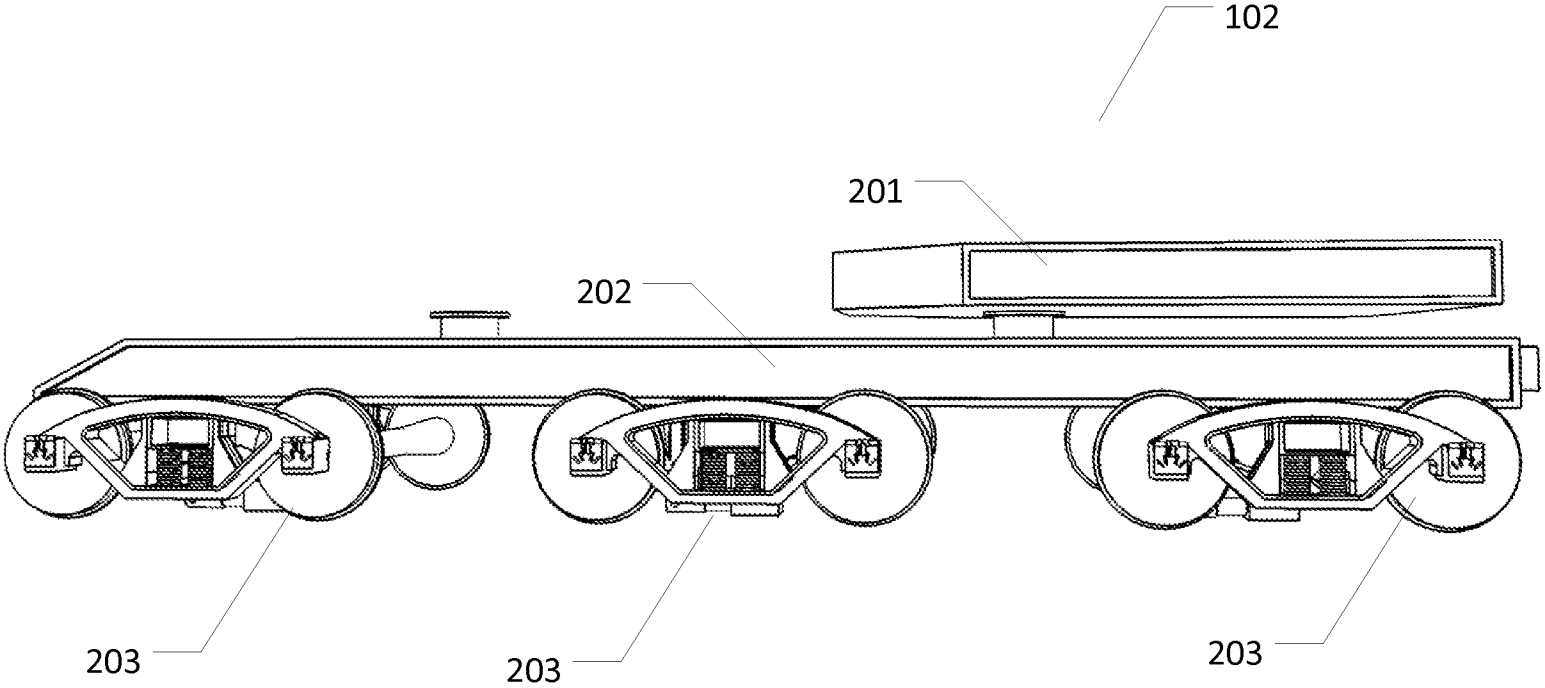
FIG. 3 illustrates a span bolster that mounts to three 2-axle truck assemblies.

FIG. 3 illustrates railcar 101. In a preferred embodiment, truck assemblies can be 2-axle. Span bolsters 202 can be a support structure that links truck assemblies 203. As such, span bolsters 202 can allow each truck assembly 203 to move relative to the other, as discussed further below. Moreover, span bolsters 202 can allow each end of railcar system 102 to rotate at a common point. Additionally, span bolsters 202 can be utilized to distribute the weight of truck body 201 on each truck assemblies 203. Truck assemblies 203 can be a device mounting span bolsters 202 that permit truck body 201 to be maneuvered within railway 104. Truck assemblies 203 can be the base support of railcar 101.

Figure 4:
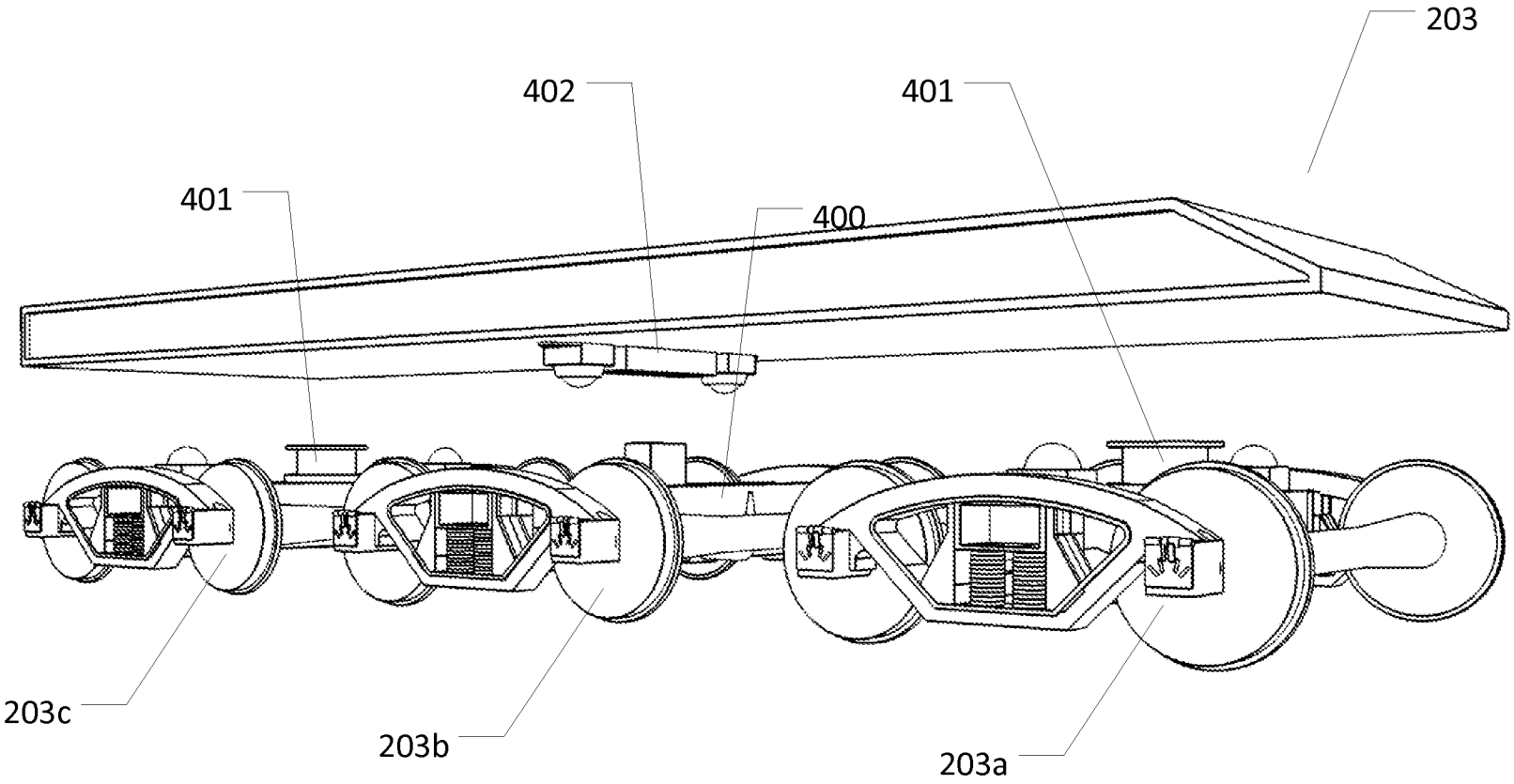
FIG. 4 illustrates a top view of a truck assemblies mounted on a span bolster.

FIG. 4 illustrates a top view of truck assemblies 203. This embodiment illustrates that truck assemblies 203, each a comprising rotatable assembly 401 or a sliding assembly 402. In this embodiment truck assembly 203*a* and truck assembly 203*c* positioned at the outer ends of span bolster 202*a* can employ rotatable assembly 401. Truck assemblies 203 can comprise a center frame 400. Rotatable assembly 401, mounted to center frame 400, can allow the rotational movements for truck assemblies 203 on both ends of span bolster 202*a*. As such, truck assemblies 203*a* and 203*c* can be rotatably mounted at each end of span bolsters 202*a*. Meanwhile, truck assembly 203*b* positioned at the middle of span bolster 202*a* can utilize sliding assembly 402. Sliding assembly 402, also mounted to center frame 400 can use a track and guide method configured to allow sideward movements for truck assembly 203*b*.

Figure 5A:
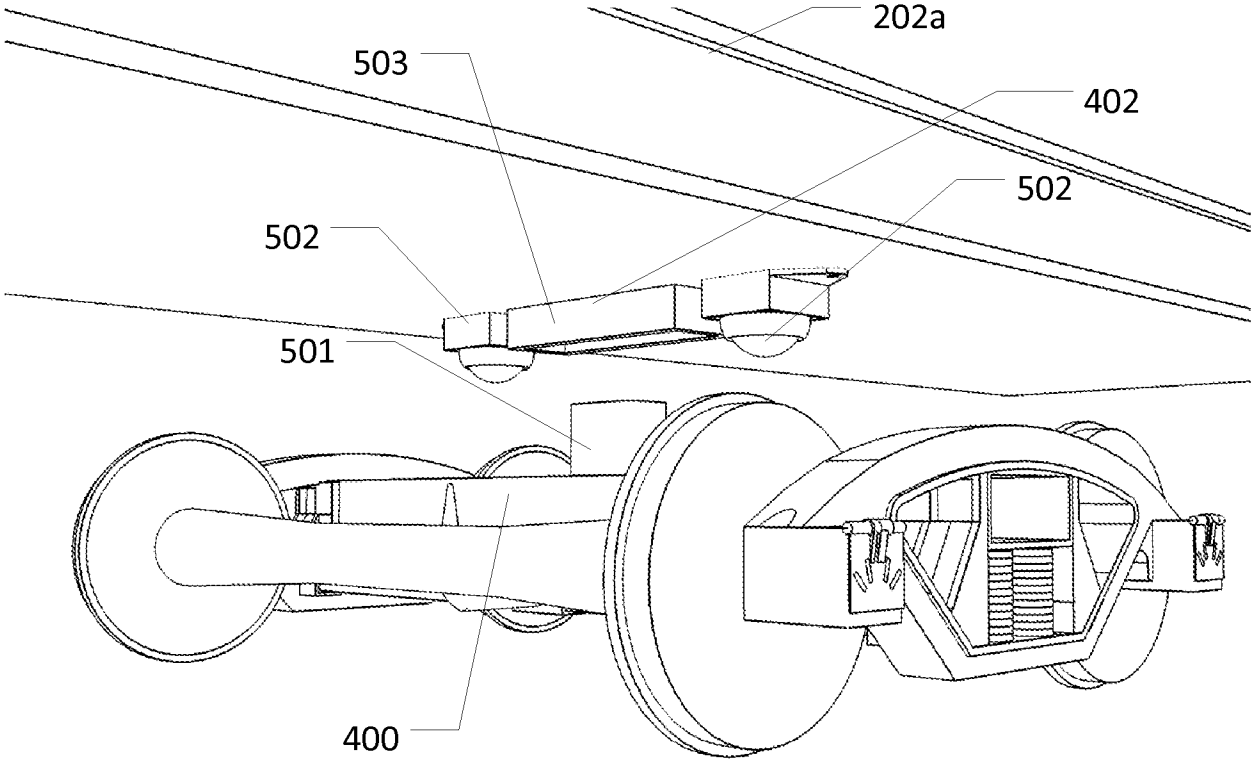
FIG. 5A illustrates an embodiment of a sliding assembly.

FIG. 5A illustrates an embodiment of sliding assembly 402. In this embodiment, truck assembly 203*b* can comprise a shaft 501. Shaft 501 can protrude upward from the middle portion of center frame 400. Shaft 501 can be attached to center frame 400 through soldering, welding, cementing, cast together, or through any fasteners.

Span bolster 202 can comprise a plurality of bearing system 502 and a horizontal slot 503. Bearing systems 502 can be placed at the opposite sides of span bolster 202. In one embodiment, bearing systems 502 can be horizontally offset from horizontal slot 503. In another embodiment, bearing systems 502 can be horizontally in line with horizontal slot 503. Bearing system 502 can rotate in place, allowing for low friction movement of span bolster 202. In one embodiment, horizontal slot 503 can protrude from the bottom surface of span bolster 202. In such embodiment, bearing system 502 can be built into the protruding rim of horizontal slot 503. In another embodiment, horizontal slot 503 can recede into the bottom surface of span bolster 202, such that horizontal slot 503 is flush with the bottom surface of span bolster 202.

Figure 5B:
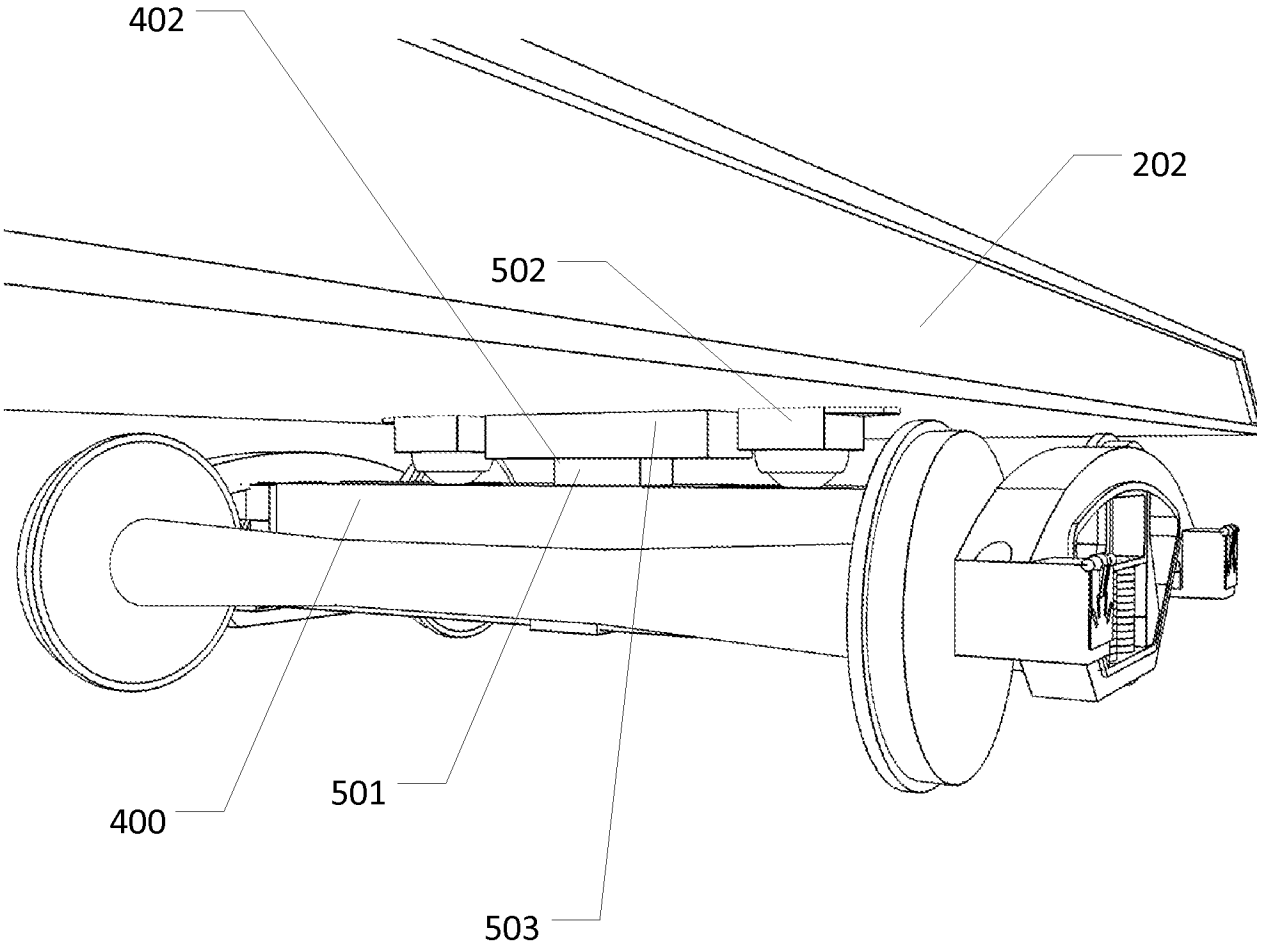
FIG. 5B illustrates how an embodiment of a sliding assembly can be connected with a span bolster.

FIG. 5B illustrates how an embodiment of sliding assembly 402 can be connected with span bolster 202. Span bolster 202 can mount on top of truck assembly 203 such that shaft 501 of truck assembly 203*b* can be inserted within horizontal slot 503. Shaft 501 can extend upward into slot 503, however the length of shaft shall be such that it does not hit the back of slot when bearings are resting on center frame 400. In an embodiment where horizontal slot 503 protrudes, such protrusion can be shorter than bearing system 502 so as not to hit horizontal slot 503. When horizontal slot 503 is flush, shaft 501 can be longer than bearing systems 502 so that it reaches inside horizontal slot 503.

Figure 6A:
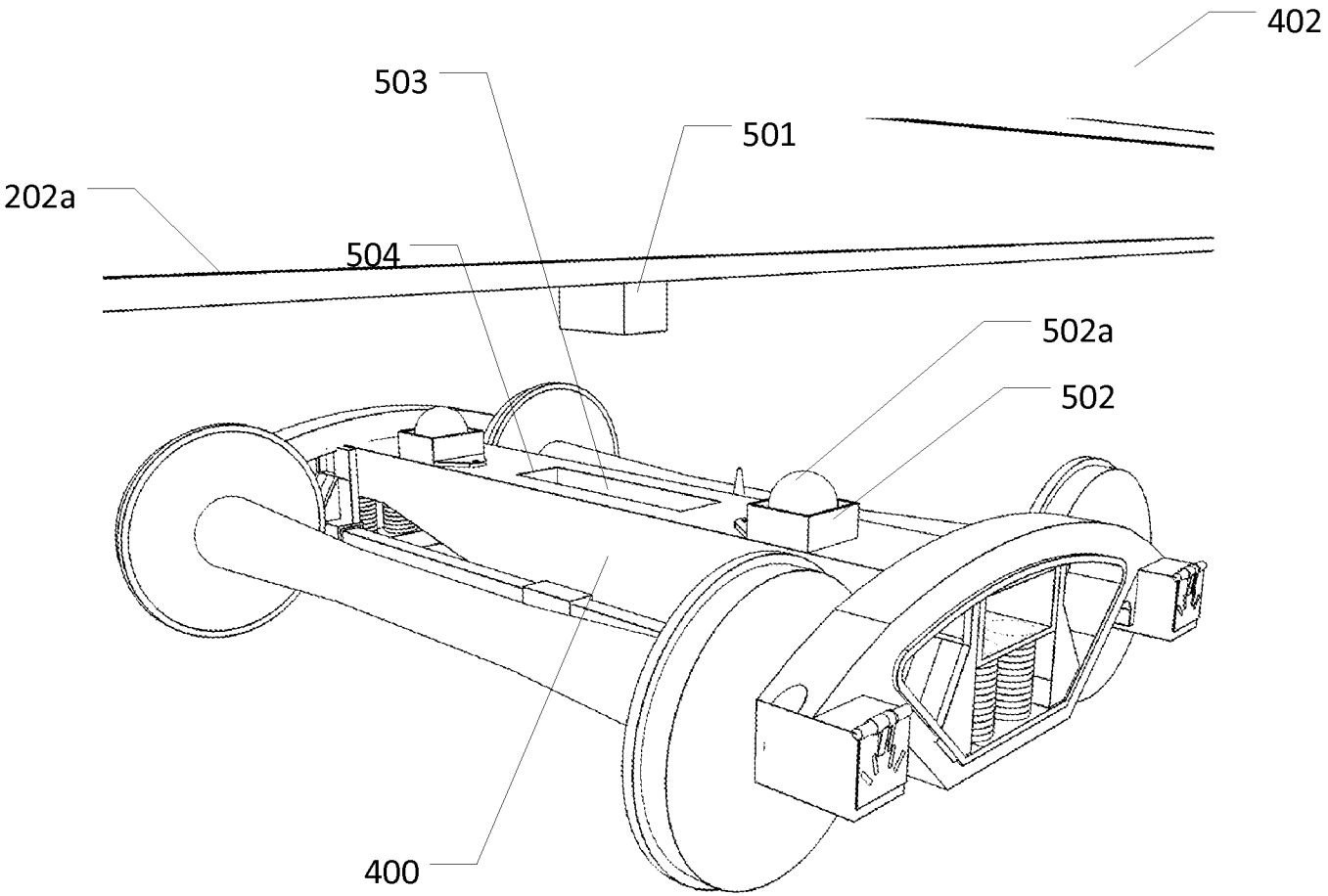
FIG. 6A illustrates another embodiment of a sliding assembly.

FIG. 6A illustrates another embodiment of sliding assembly 402. Truck assembly 203*b* can comprise horizontal slot 503 and/or bearing systems 502. In one embodiment, horizontal slot 503 can recede into the middle of center frame 400. As such, horizontal slot 503 can form a recessed portion within the middle section of center frame 400. In another embodiment, horizontal slot 503 can protrude from center frame 400. In this embodiment, side bearings 502 can be higher than the walls of horizontal slot 503. Furthermore, horizontal slot 503 can be attached to center frame 400 through soldering, welding, cementing or through any fasteners.

In this embodiment, shaft 501 can be positioned at the center of span bolster 202*a* such that when span bolster 202*a* mounts on top of truck assembly 203*b*, shaft 501 can be inserted within horizontal slot 503. In an embodiment wherein horizontal slot 503 recedes truck assembly 203*b*, shaft 501 attached to span bolster 202*a* can be higher than side bearings 502. This is to allow shaft 501 be mated within horizontal slot 503. In another embodiment wherein said horizontal slot 503 protrudes from truck assembly 203*b*, shaft 501 can be shorter than side bearings 502. Such embodiment ensures that span bolsters 202*a* can rest on side bearings 502 but still allowing shaft 501 mated within horizontal slot 503 of truck assembly 203*b*.

Figure 6B:
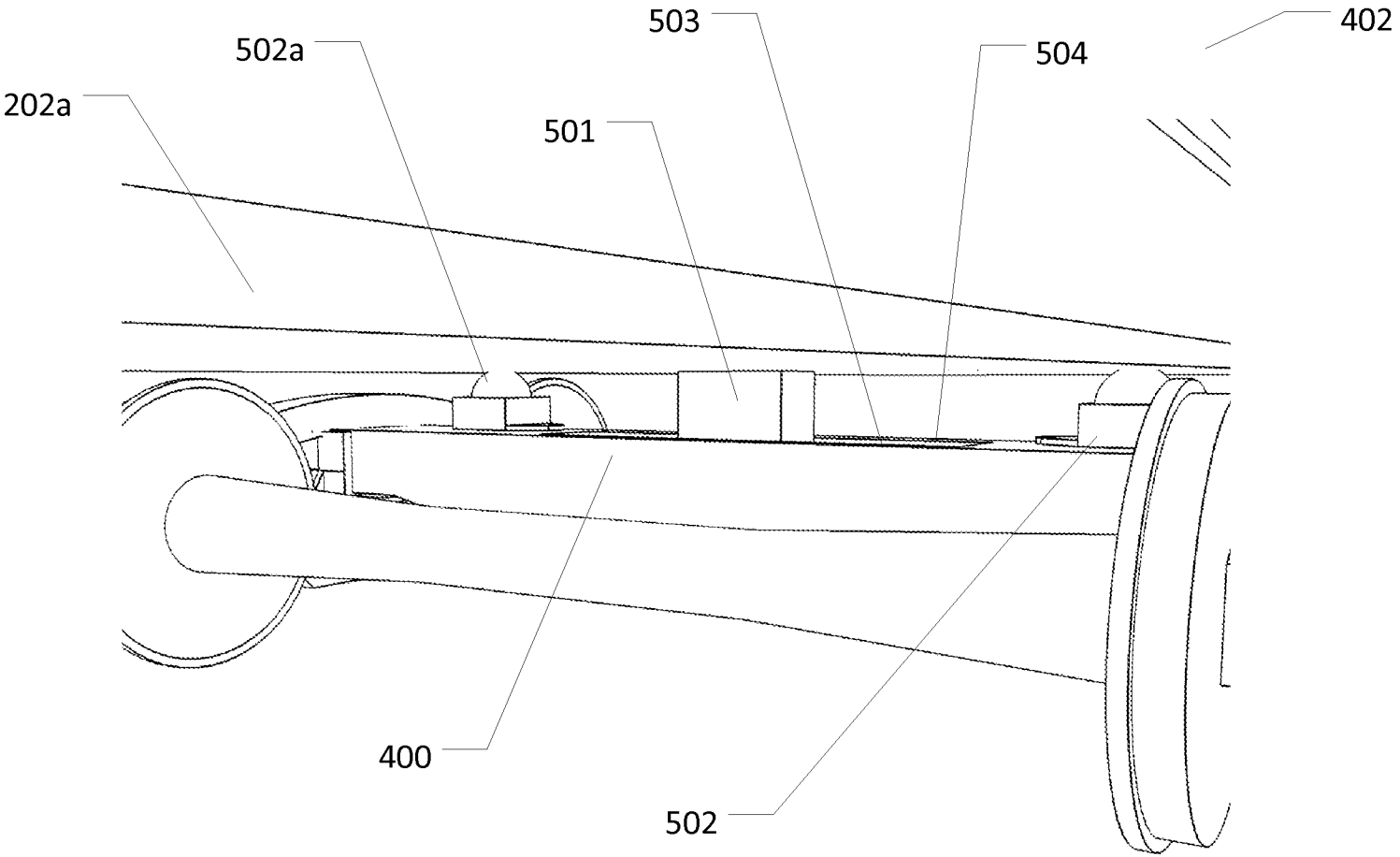
FIG. 6B illustrates how another embodiment of sliding assembly can be connected with a span bolster.

FIG. 6B illustrates how another embodiment of sliding assembly 402 can be connected with span bolster 202*a*. The embodiments for sliding assembly 402 can be configured such that the outer end of shaft 501 does not reach the inner surface of horizontal slot 503. This can prevent friction between shaft 501 and horizontal slot 503 therefore allowing shaft 503 to slide freely within horizontal slot 503. Furthermore, side bearings 502 can allow span bolster 202*a* move relatively with truck assembly 203*b*.

Figure 7A:
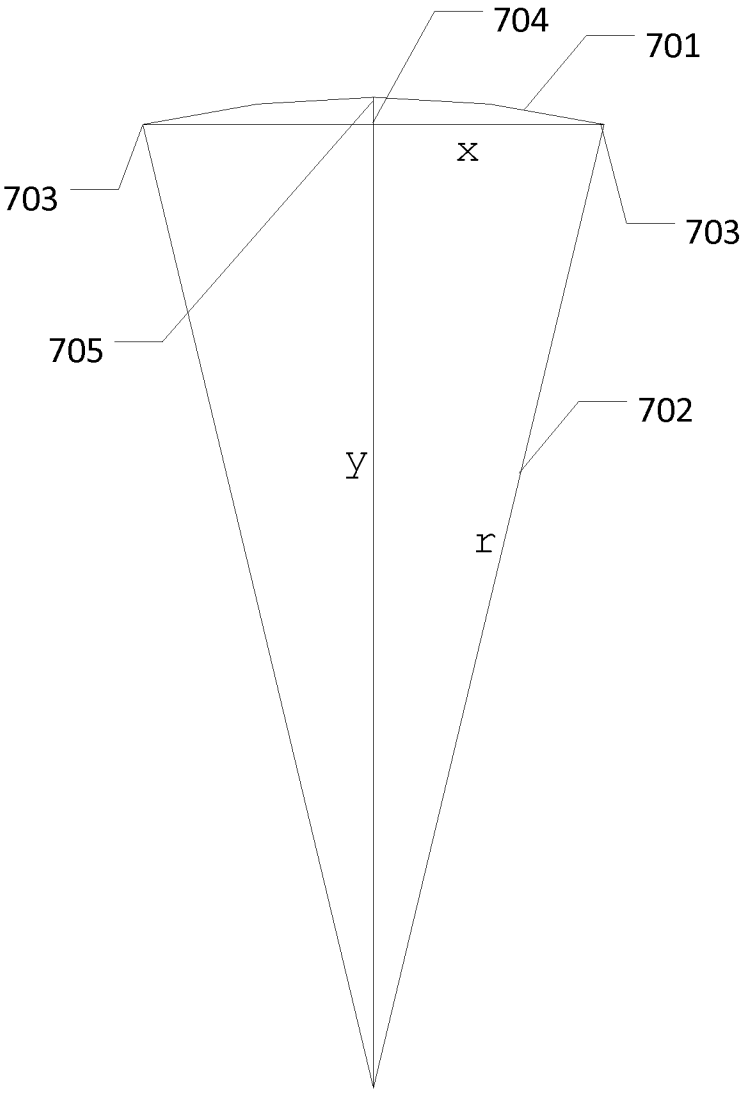
FIG. 7A illustrates a line representation of railcar 101 on railway 104.

FIG. 7A illustrates a line representation of railcar 101 on railway 104. For any railway 104, a railway commission or other governing body will dictate a minimum radius 702 for curve 701. Points 703 represent the position of rotatable assembly 401. Specifically, points 703 can be the axis wherein outer truck assemblies 203*a* and 203*c* can rotate relative to span bolster 202. The line that connects points 703 represents the center of span bolster 202. As span bolster 202 is a rigid body, the center of span bolster will deviate from curve 701. In a scenario wherein railcar system 102 crosses a curved track 104 a horizontal deflection 705 that can be measured. Such horizontal deflection 705 is at its maximum at a center point 704 between points 703. In an embodiment wherein shaft 501 attaches to span bolster 202, center point 704 represents the center of shaft 501. In an embodiment wherein span bolster 202 comprises horizontal slot 503, center point 704 represents the center of horizontal slot.

Figure 7B:
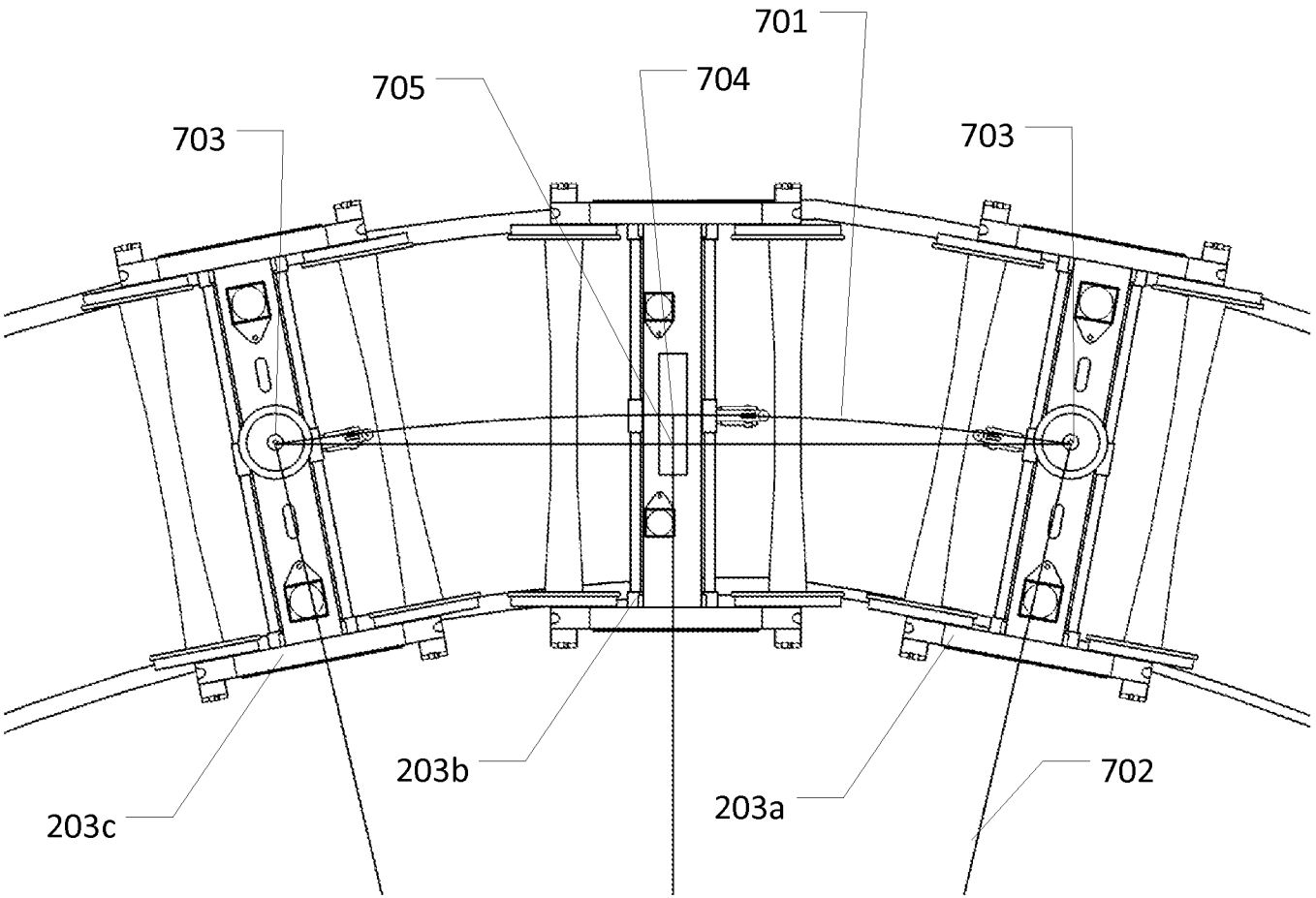
FIG. 7B illustrates arrangement of truck assemblies on a curved track.

FIG. 7B illustrates arrangement of truck assemblies 203 on curved track 104. Thus, horizontal deflection 705 represents minimum displacement room on each side of shaft 501 within horizontal slot 503 necessary for railcar 101 to pass along railway 104 having curve 701. To ensure proper alignment of truck assembly 203*b*, horizontal deflection 705 can be determined as r(1−cos(sin ^−1(x/r))), wherein r can represent the minimum allowable radius 702, and x can represent half the distance between points 703. From r(1−cos(sin ^−1(x/r))), it can be established that the horizontal deflection 705 can be at its largest when minimum allowable radius 702 is smallest. Similarly, it can be concluded that horizontal deflection 705 can be at its smallest when radius 702 is largest.

Figure 7C:
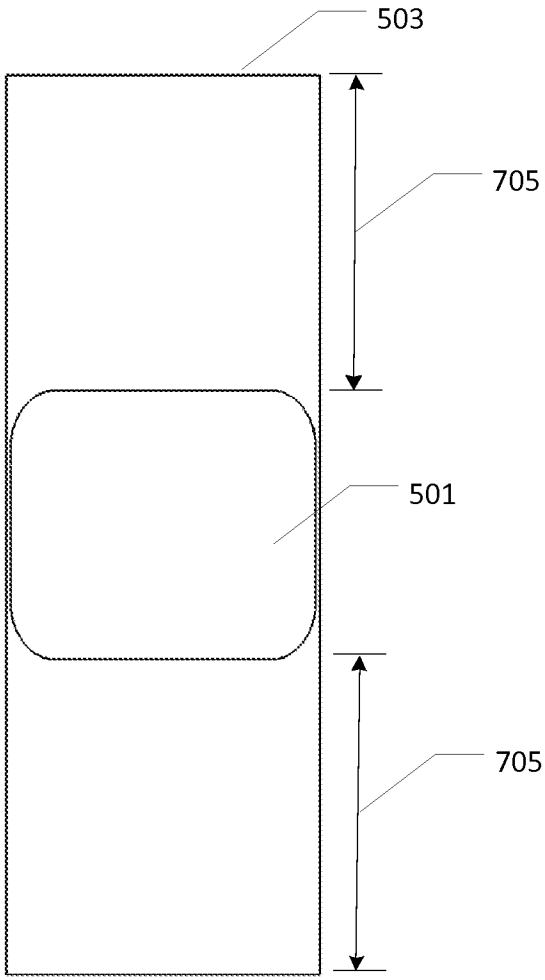
FIG. 7C illustrates a top view of a horizontal slot.

FIG. 7C illustrates a top view of horizontal slot 503. When railcar system 102 travels a straight track 103, shaft 501 can rest at the middle of horizontal slot 503. However, the width of horizontal slot 503 should be chosen such that shaft 501 has a displacement distance on each side equal to or greater than r(1−cos(sin ^−1(x/r))). Further, such displacement distance should be afforded horizontally to bearing systems 502. Otherwise, sliding movement between span bolster 202 and truck assembly 203*b* can be limited. This is to prevent span bolster 202 from dislodging from truck assembly 203*b*. Truck assembly 203*b* can employ a sliding assembly 402 since truck assembly 203*b* will typically be substantially orthogonal with curved track 104. As such, no rotation is necessary for truck assembly 203*b*.

In a preferred embodiment, sides of horizontal slot 503 and shaft 501 are flat, and shaft is sized such that its flat edges fit snuggly within horizontal slot 503. Such embodiment can prevent rotational movement of truck assembly 203*b*. Edges of shaft 501 can be rounded to reduce friction with the sides of horizontal slot 503.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

What is claimed is:

1. A railcar comprising a span bolster comprising a horizontal slot, wherein said horizontal slot comprises a width;

outer truck assemblies rotatably mounted to each end of said span bolster; and a middle truck assembly slidably non-rotatably mounted at a middle portion of said span bolster, said middle truck assembly comprises a shaft, said shaft mateable with said horizontal slot, such that said shaft is non-rotatable, further wherein said width is chosen such that said shaft is horizontally displaceable from a center position in both directions by a distance equal to r(1−cos sin ^−1(x/r))), wherein said r is a minimum allowable radius for a track turn, and said x is a distance between said horizontal slot and a rotation point.

2. The railcar of claim 1 wherein said span bolster further comprising a plurality of side bearings, at least one of said side bearings positioned at the opposite sides of said span bolster.

3. The railcar of claim 1 wherein said horizontal slot protrudes from said span bolster.

4. The railcar of claim 1 wherein said horizontal slot recedes into said span bolster.

5. The rail car of claim 1 wherein a portion of said shaft that extend into said slot comprises round edges.

6. A railcar comprising a span bolster comprises a shaft;

outer truck assemblies rotatably mounted to each end of said span bolster; and a middle truck assembly slidably non-rotatably mounted at a middle portion of said span bolster, said middle truck assembly comprises a horizontal slot, said horizontal slot comprises a width, said shaft mateable with said horizontal slot, such that said shaft is non-rotatable, further wherein said width is chosen such that said shaft is horizontally displaceable from a center position, in both directions by a distance equal to r(1−cos(sin ^−1(x/r))), wherein said r is a minimum allowable radius for a track turn, and said x is a distance between said horizontal slot and a rotation point.

7. The railcar of claim 6 wherein said middle truck assembly further comprising a plurality of side bearings, said side bearings positioned at the opposite ends of said middle truck assembly.

8. The railcar of claim 6 wherein said horizontal slot protrudes from said middle truck assembly.

9. The railcar of claim 6 wherein said horizontal slot recedes into said middle truck assembly.

10. The rail car of claim 6 wherein a portion of said shaft that extend into said slot comprises round edges.

11. A railcar system comprising a pair of railcars, wherein each of said railcar comprising a span bolster comprising a horizontal slot, wherein said horizontal slot comprises a width;

outer truck assemblies rotatably mounted to each end of said span bolsters; and a middle truck assembly slidably mounted at the middle portion of said span bolsters, said middle truck assembly comprises a shaft wherein said shaft mateable with said horizontal slot, further wherein said width is chosen such that said shafts are horizontally displaceable from a center position in both directions by a distance equal to r(1−cos(sin ^−1(x/r))), wherein said r is a minimum allowable radius for a track turn, and said x is a distance between one of said horizontal slots and an adjacent rotation point; and a body having to ends, each end connected to one of said span bolsters.

12. The rail car of claim 11 wherein a portion of each of said shafts comprises round edges.

13. A railcar comprising a pair of railcars, wherein each of said railcar comprising a span bolsters comprising a shaft;

outer truck assemblies rotatably mounted to each end of said span bolster; and further wherein each of said a middle truck assemblies comprises a horizontal slot, said horizontal slot comprises a width, said shaft mateable with said horizontal slot, further wherein said width is chosen such that said shaft is horizontally displaceable from a center position, in both directions by a distance dual to r(1−cos(sin ^−1(x/r))), wherein said r is a minimum allowable radius for a track turn, and said x is a distance between said horizontal slot and a rotation point; and a body having to ends, each end connected to one of said span bolsters.

14. The rail car of claim 13 wherein a portion of each of said shafts comprises round edges.

* * * * *